US009614288B2

(12) United States Patent
Lerosey et al.

(10) Patent No.: US 9,614,288 B2
(45) Date of Patent: Apr. 4, 2017

(54) DEVICE FOR RECEIVING AND/OR EMITTING A WAVE, A SYSTEM COMPRISING THE DEVICE, AND USE OF SUCH DEVICE

(75) Inventors: Geoffroy Lerosey, Paris (FR); Christian Leray, Courdimanche (FR); Fabrice Lemoult, Paris (FR); Julien De Rosny, Nogent sur Marne (FR); Arnaud Tourin, Sevres (FR); Mathias Fink, Meudon (FR)

(73) Assignees: TIME REVERSAL COMMUNICATIONS, Cergy Saint Christophe (FR); CENTRE NATIONAL DE LA RECHERCHE SCIENTIFIQUE (CNRS), Paris (FR)

( * ) Notice: Subject to any disclaimer, the term of this patent is extended or adjusted under 35 U.S.C. 154(b) by 533 days.

(21) Appl. No.: 14/114,977

(22) PCT Filed: May 6, 2011

(86) PCT No.: PCT/IB2011/002453
§ 371 (c)(1),
(2), (4) Date: Oct. 31, 2013

(87) PCT Pub. No.: WO2012/153164
PCT Pub. Date: Nov. 15, 2012

(65) Prior Publication Data

US 2014/0062821 A1 Mar. 6, 2014

(51) Int. Cl.
*H01Q 15/00* (2006.01)
*H01Q 1/40* (2006.01)
*H01Q 3/44* (2006.01)

(52) U.S. Cl.
CPC ..... *H01Q 15/006* (2013.01); *H01Q 1/40* (2013.01); *H01Q 3/446* (2013.01)

(58) Field of Classification Search
None
See application file for complete search history.

(56) References Cited

U.S. PATENT DOCUMENTS 6,549,172 B1 4/2003 Thevenot et al.
6,975,269 B2 12/2005 Jecko et al.
(Continued)

FOREIGN PATENT DOCUMENTS

FR 2801428 5/2001
FR 2830131 3/2003
(Continued)

OTHER PUBLICATIONS

International Search Report dated Mar. 23, 2012 for Application No. PCT/IB2011/002453.
(Continued)

*Primary Examiner* — Robert Karacsony
(74) *Attorney, Agent, or Firm* — Pillsbury Winthrop Shaw Pittman LLP

(57) ABSTRACT

A device (10) for receiving and/or emitting an electromagnetic wave, comprising a medium (11) of dielectric material, a plurality of passive resonant elements (12) incorporated inside said medium, the plurality of passive resonant elements (12) comprising a frequency band-gap, two neighbor passive resonant elements belonging to the plurality being spaced apart from each other of a first distance lower than λ/4, and at least one active resonant element (13) incorporated inside said plurality, said active resonant element (13) having a second structure different from a first structure of the passive resonant elements (12), so that said active resonant element (13) has at least a second resonance frequency comprised inside the frequency band-gap of said plurality of passive elements (12).

16 Claims, 5 Drawing Sheets

(56) References Cited

U.S. PATENT DOCUMENTS

| | | | | |
|---|---|---|---|---|
| 7,233,299 | B2 | 6/2007 | Thevenot et al. | |
| 7,242,368 | B2 | 7/2007 | Thevenot et al. | |
| 7,411,564 | B2 | 8/2008 | Thevenot et al. | |
| 7,522,105 | B1 | 4/2009 | LaComb | |
| 7,636,070 | B2 | 12/2009 | De Lustrac et al. | |
| 2007/0080891 | A1* | 4/2007 | De Lustrac ..... | H01Q 3/446<br>343/909 |

FOREIGN PATENT DOCUMENTS

| | | |
|---|---|---|
| FR | 2854735 | 11/2004 |
| FR | 2854738 | 11/2004 |
| FR | 2863109 | 6/2005 |
| WO | WO 01/71774 | 9/2001 |
| WO | WO 2008/003991 | 1/2008 |
| WO | WO 2008/007024 | 1/2008 |

OTHER PUBLICATIONS

Llombart, N. et al. "1-D scanning Arrays on Dense Dielectrics Using PCS-EBG Technology" IEEE Transactions on Antennas and Propagation, vol. 55, No. 1, Jan. 2007.

Abstract and English Machine Translation for French Patent No. FR 2801428.

Abstract and English Machine Translation for French Patent No. FR 2830131.

Abstract and English Machine Translation for French Patent No. FR 2854735.

Abstract and English Machine Translation for French Patent No. FR 2854738.

Abstract and English Machine Translation for French Patent No. FR 2863109.

* cited by examiner

FIG. 5a
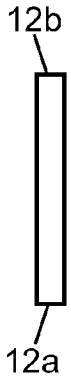
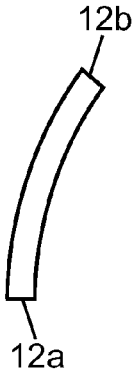
FIG. 5b
FIG. 5c
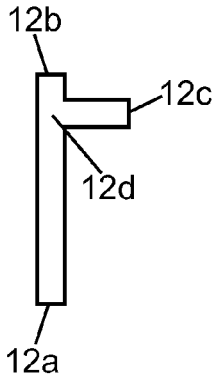
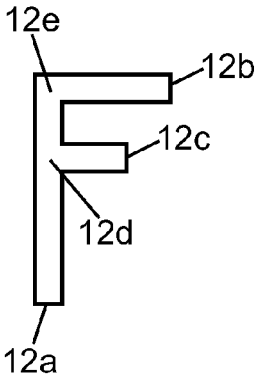
FIG. 5d
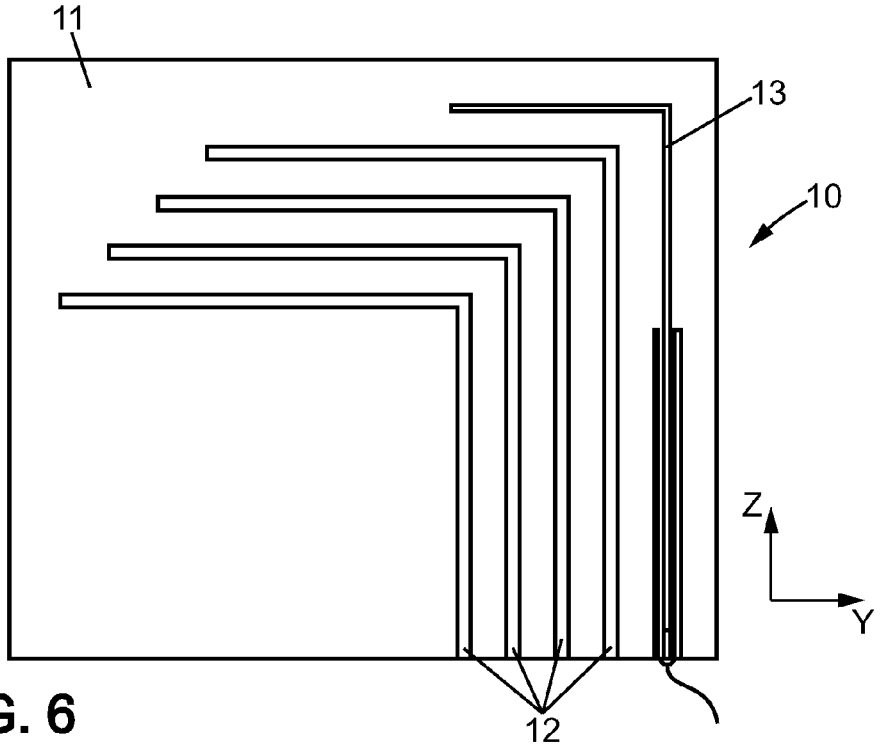
FIG. 6

DEVICE FOR RECEIVING AND/OR EMITTING A WAVE, A SYSTEM COMPRISING THE DEVICE, AND USE OF SUCH DEVICE

FIELD OF THE INVENTION

The present invention concerns a device for receiving and/or emitting an electromagnetic wave, a system comprising said device, and a use of such device.

BACKGROUND OF THE INVENTION

For example, it is known from FR-2 863 109, a device for receiving and/or emitting an electromagnetic wave, comprising a plurality of passive reflective elements. The passive reflective elements are periodically spaced inside the device, and said device uses specific Bragg law electromagnetic properties.

However, the passive reflective elements are spaced from each other of a distance that is a multiple of the wavelength $\lambda$. The distance is about $\lambda/2$ or greater and such device has a large size.

It is also known from the patent application WO-2008/007024, a device having a reactive type antenna element surrounded by a plurality of metallic diffusers. Thanks to this arrangement, the electromagnetic wave is focused to a point i near the antenna element at a sub wavelength distance. Such device does not near to have a period pattern of metallic diffusers.

However, such device does not have a preferred direction for the electromagnetic wave.

All these devices still need to be improved, in the view of increasing their efficiency and reducing their size.

OBJECTS AND SUMMARY OF THE INVENTION

One object of the present invention is to provide an improved device for receiving and/or emitting an electromagnetic wave.

To this effect, the present invention proposes a device receiving and/or emitting an electromagnetic wave having a free space wavelength $\lambda_0$ comprised between 1 mm and 10 m, comprising:

- a medium of dielectric material, the free space wavelength $\lambda_0$ corresponding to a wavelength $\lambda$ inside said medium,
- a plurality of passive resonant elements incorporated inside said medium, each passive resonant element having a first structure comprising at least a first shape and first physical parameters, the first structure being the same for all the passive resonant elements belonging to said plurality, each passive resonant element having at least a first resonance frequency, the plurality of passive resonant elements comprising a frequency band-gap, two neighbour passive resonant elements belonging to the plurality being spaced apart from each other of a first distance lower than $\lambda/4$,
- at least one active resonant element incorporated inside said plurality, said active resonant element being spaced apart from a passive resonant element of a second distance lower than $\lambda/4$, said active resonant element having a second structure comprising at least a second shape and second physical parameters, said second structure being different from the first structure so that said active resonant element has at least a second resonance frequency comprised inside the frequency band-gap of said plurality of passive elements, said active resonant element being connected to an electronic device for receiving or emitting an signal having at least a frequency component substantially equal to the second frequency.

Thanks to these features, the device for receiving and/or emitting an electromagnetic wave is small compared to the equivalent known devices of the prior art.

The passive resonant elements are coupled to each others, and the device does not use the Bragg law: the passive resonant elements can be periodic or non periodic inside the medium.

The device uses a band-gap that is known as an hybridization band-gap.

A first region of the device comprising the passive resonant elements is preventing a propagation of electromagnetic waves at the second resonance frequency from the active resonant element through said first region. The device comprises a directivity diagram that is determined by the shape of said first region. The device is able to emit and/or receive an electromagnetic wave according to one or a plurality of predetermined directions.

The electromagnetic energy at the second resonance frequency is concentrated inside a second region around the active resonant element. The device is able to emit and/or receive an electromagnetic wave at a greater distance from itself. The device has a greater sensitivity and is more efficient.

In various embodiments of the device, one and/or other of the following features may optionally be incorporated.

According to another aspect of the invention, the second shape is identical to said first shape, and at least one of the second physical parameters of the second structure is different to a corresponding first physical parameter of the first structure.

According to another aspect of the invention, the first and second physical parameters comprise sizes and materials of the first and second structure, respectively.

According to another aspect of the invention, the first distance and the second distance are lower than $\lambda/10$.

According to another aspect of the invention, the passive resonant elements are not periodically disposed inside the medium.

According to another aspect of the invention, the active resonant element is in proximity of a lateral surface of the medium.

According to another aspect of the invention, the active resonant element is at a third distance from the lateral surface, said third distance being lower than the wavelength $\lambda$.

According to another aspect of the invention, the device further comprises at least two active resonant elements, said two active resonant elements being separated from each other of a forth distance, and wherein said two active resonant elements have different second resonance frequencies, each of them being comprised inside said band-gap.

The two active resonant elements can therefore emit independent and uncorrelated electromagnetic waves.

According to another aspect of the invention, the forth distance is lower than the wavelength $\lambda$, and preferably lower than $\lambda/4$.

According to another aspect of the invention, the forth distance is adapted so that at least one passive resonant element is substantially between said two active resonant elements.

According to another aspect of the invention, the two active resonant elements are positioned symmetrically in comparison to a geometrical centre of said device.

According to another aspect of the invention, the device further comprises:

a plurality of passive resonant elements having the same first shapes and same first physical parameters, each passive resonant elements having a plurality of first resonance frequencies, and the plurality of passive resonant elements comprising at least a first band-gaps and a second band-gap, and at least two active resonant elements, said to active resonant elements being separated from each other of a forth distance, and wherein said two active resonant elements have different second resonance frequencies respectively, the first second resonance being comprised inside a first band-gap of said plurality of passive resonant elements, and the second second resonance being comprised inside a second band-gap of said plurality of passive resonant elements.

The two active resonant elements can therefore emit independent and uncorrelated electromagnetic waves.

According to another aspect of the invention, the device further comprises:

at least two sets of passive resonant elements, said sets having the same first shapes and different first physical parameters, so that a first set comprises a first band-gap and a second set comprises a second band-gap, and at least two active resonant elements, said to active resonant elements being separated from each other of a forth distance, and wherein said two active resonant elements have different second resonance frequencies respectively, the first second resonance being comprised inside the first band-gap, and the second second resonance being comprised inside the second band-gap.

The two active resonant elements can therefore emit independent and uncorrelated electromagnetic waves.

According to another aspect of the invention, the first and second shapes are wires of electrical conductors, the first resonance frequency depending on a length of said first shape, and the second resonance frequency depending on a length of said second shape.

According to another aspect of the invention, the first and second shapes are split rings of electrical conductors, the first resonance frequency depending on an electric capacitor and an electric inductance of said first shape, and the second resonance frequency depending on an electric capacitor and an electric inductance of said second shape.

According to another aspect of the invention, the first and second shapes are slots on an electrical conductor plate, the first resonance frequency depending on a perimeter length of the slot of said first shape, and the second resonance frequency depending on a length of the slot of said second shape.

Another object of the present invention is to provide a system comprising a device for receiving and/or emitting an electromagnetic wave, wherein the active resonant element is connected to an electronic device for receiving and/or emitting a signal representative to said electromagnetic wave, said electric signal having at least a frequency component substantially equal to the second frequency.

Another object of the present invention is to use a device for receiving and/or emitting an electromagnetic wave having a free space wavelength $\lambda$ comprised between 1 mm and 1 m, and preferably between 10 cm and 40 cm.

BRIEF DESCRIPTION OF THE DRAWINGS

Other features and advantages of the invention will be apparent from the following detailed description of three of its embodiments given by way of non-limiting examples, with reference to the accompanying drawings. In the drawings:

FIGS. 5*a* to 5*d* are four variants of a passive or active resonant element belonging to the device of FIG. 1, FIG. 6 is a view of a folded shape variant of the first embodiment.

MORE DETAILLED DESCRIPTION

In the various figures, the same reference numbers indicate identical or similar elements. The direction Z is a vertical direction. A direction X or Y is a horizontal or lateral direction.

Figure 1:
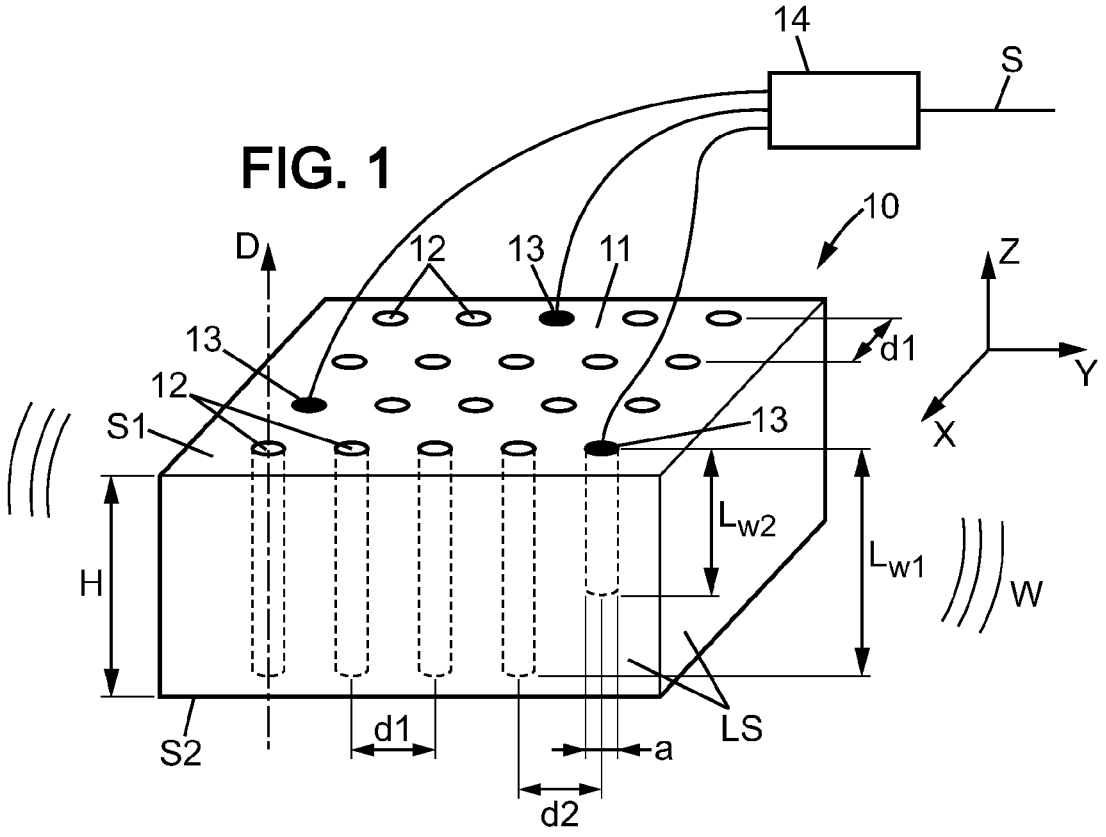
FIG. 1 is a perspective view of a first embodiment of a device for receiving or emitting an electromagnetic wave according to the invention.

FIG. 1 shows a first embodiment of a device 10 for receiving or emitting an electromagnetic wave W in a space and having a free space wavelength $\lambda_0$ comprised between 1 mm and 10 m, and preferably between 10 cm and 40 cm.

This device comprises:

a medium 11 of dielectric material, a plurality of passive resonant elements 12 incorporated inside said medium 11, and at least one active resonant element 13 incorporated inside said plurality of passive resonant elements 12, said active resonant element 13 being intended to be connected to an electronic device 14 for receiving or emitting an electric signal S representative of said electromagnetic wave W.

The medium 11 has a refractive index $n_d$.

The space may be air. In that case, its refractive index is equal to one.

The free space wavelength $\lambda_0$ corresponds to a wavelength $\lambda$ inside the medium 11 with the following well-known relation: $n_d \cdot \lambda = \lambda_0$.

The medium 11 is for example a parallelepiped, comprising a first surface S1 and a second surface S2, the second surface S2 being opposite to said first surface along the vertical direction Z. The first and second surfaces S1, S2 are substantially parallel planes. A direction D is substantially a straight line perpendicular to said surfaces and parallel to the vertical direction Z. The first and second surfaces S1, S2 are distant of a height value H.

The medium 11 has an electric permeability of $\epsilon_d$.

In present description, we consider that the passive resonant elements 12 have a first structure comprising at least a first shape and first physical parameters.

In case of the first embodiment of the invention:

the first structure is an electrical conductive wire;

the first shape is a strait line having the direction D; and the first physical parameters comprise a diameter a, a length Lw1 of each electrical wire, and a chosen material for the electrical conductive wire.

The length Lw1 of each passive resonant element is for example equal to the height value H of the medium 11.

In other words, each passive resonant element 12 of the first embodiment are electrical conductive wires having a diameter a and extending along the direction D according to a length Lw1 between a first end 12*a* above the first surface S1 and a second end 12*b* above second surface S2.

In this first embodiment the passive resonant elements 12 form on the first surface S1 or any plane XY perpendicular to said vertical direction Z a regularly spaced square grid. The passive resonant elements 12 are parallel to each other along the vertical direction Z.

The passive resonant elements 12 have at least one resonance frequency $f_1$, a first resonance frequency.

The passive resonant elements 12 are spaced from each other along the direction X or Y of a first distance dl lower than $\lambda/4$, and preferably lower than $\lambda/10$. This sub-wavelength first distance dl is the step of said grid.

The passive resonant elements 12 are therefore electromagnetically coupled to each other.

Thanks to this feature, a hybridization band-gap is created around the first resonance frequency $f_1$. In the present case of electrical conductive wires, the band-gap will be above the resonance frequency of a single wire.

The passive resonant elements 12 form on FIG. 1 a regular lattice of wires (periodically spaced). But, such device can be operational if the passive resonant elements 12 are not regularly and periodically spaced.

FIGS. 5*a* to 5*d* represents a plurality of variants for the first shape of the passive resonant elements 12.

On FIGS. 5*a* and 5*b*, the passive resonant elements 12 are composed of a single wire. The first resonance frequency $f_1$ depends on the length $L_{w1}$ that is a curvilinear length between the first end 12*a* and the second end 12*b*.

A first resonance wavelength $\lambda_1$ is determined by:

$$\lambda_1/2=L_{w1}^*$$

where $L_{w1}^*$ is a first electrical length corresponding to said first geometrical length $L_{w1}$ of the passive resonant element 12.

In fact, the length $L_{w1}$ generates a plurality of first resonance frequencies $f_1$, each of them being multiple of the first one. But, the present description will only refer to the first one of them for simplicity.

The first resonance frequency $f_1$ is:

$$f_1=c/\lambda_1,$$

$$\text{i.e.: } f_1=c/(2\cdot L_{w1}^*),$$

where c is the speed of a wave (light) in the vacuum space.

On FIGS. 5*c* and 5*d*, the passive resonant elements 12 are composed of a main wire extending between the first end 12*a* and the second end 12*b*, connected to additional wires, for example one additional wire extending between an end 12*d* and an end 12*c*, the end 12*d* also belonging to the main wire and/or being connected to said main wire at an intermediate position between the main wire ends 12*a*, 12*b*.

Such passive resonant element comprises a plurality of geometrical lengths:

a first length $L_{w1}$ between the end 12*a* and the end 12*b*, a second length $L_{w2}$ between the end 12*a* and the end 12*c*, and a third length $L_{w3}$ between the end 12*b* and the end 12*c*.

Each of these geometrical lengths $L_{wi}$, i being an index representing a wire portion of the passive resonant element 12, is related to an electrical length $L_{wi}^*$, to a first resonance wavelength $\lambda_{11}$, and to a first resonance frequency $f_{1i}$.

A wavenumber $k_i$ corresponding to a wave is a number defined as the number of wavelengths per unit distance, i.e. $k_i=2\pi/\lambda_i$.

Figure 4:
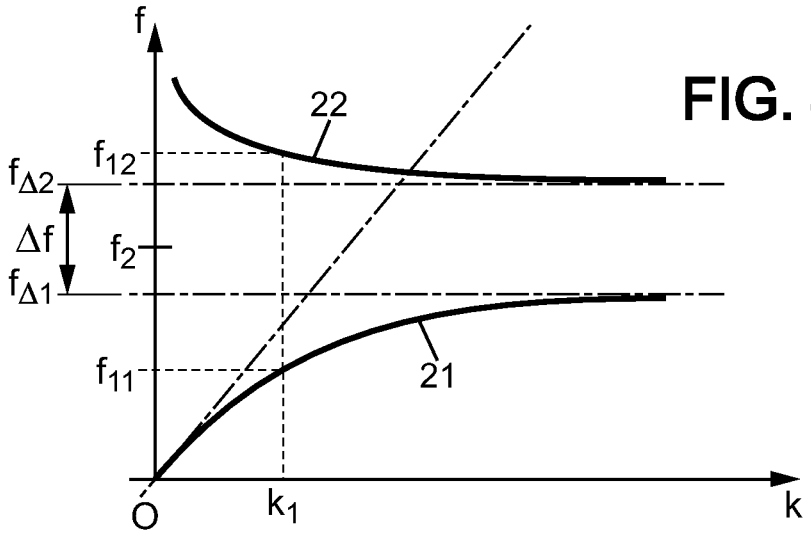
FIG. 4 is a band diagram of a device according to the invention.

The passive resonant element 12 has a plurality of resonance frequencies $f_{1i}$ that can be represented, for the plurality of all of them, in a wavenumber-frequency diagram as shown on FIG. 4. In this diagram, a particular first frequency $f_{11}$ is given for a wavenumber $k_1$. All the pairs $(f_{1i}, k_i)$ that are available for the plurality of passive resonant elements 12 are represented on this diagram by a plurality of curves 21, 22. The scattering phenomenon forms asymptotes in this diagram and creates a frequency band-gap $\Delta f$ wherein the plurality of passive resonant elements 12 does not have any possibility for the propagation of an electromagnetic wave having a frequency f belonging to said band-gap $\Delta f$, that is to say belonging to a frequency interval $[f_{\Delta 1}, f_{\Delta 2}]$.

The passive resonant elements 12 can be incorporated inside the medium 11 according to a periodic pattern. The device has a simple geometry, and the device electromagnetic properties (sensitivity, directivity, performance or efficiency) can be more easily computed and predicted before fabrication.

The passive resonant elements 12 can be incorporated inside the medium 11 according to a non periodic pattern. The device is less sensitive to fabrication uncertainties concerning the positions of the passive resonant elements 12 inside the medium 11. Such problem is well known for Bragg band-gap materials or metamaterials.

One or several active resonant elements 13 are also incorporated inside the medium 11 between the passive resonant elements 12.

The active resonant elements 13 are coupled or connected to an electronic device 14 for receiving or emitting a signal.

The active resonant elements 13 can be fed with a single electric signal S to emit or receive a single electromagnetic wave W, or they may be fed with a plurality of electric signals (one different signal for each active element) to emit or receive simultaneously the plurality of signals through a plurality of independent electromagnetic waves.

The active resonant elements 13 are close to the passive resonant elements 12. The active resonant element 13 is spaced apart from a passive resonant element 12 belonging to the plurality of resonant passive elements of a second distance d2 that is lower than $\lambda 2$, and eventually lower than $\lambda/10$.

The active resonant element 13 is preferably positioned inside the medium 11, in proximity of a periphery of said medium that is to say in proximity of lateral surface LS.

For example, the distance between the active resonant element 13 and the proximal lateral surface from said active resonant element is lower than a third distance d3. Between said active resonant element 13 and said proximal lateral surface there is no or only one passive resonant element 12. The active resonant element 13 is therefore able to emit an electromagnetic wave W laterally from said lateral surface LS (FIGS. 1 and 2), said wave W propagating in space mainly according to plane XY.

The third distance d3 is lower than the wavelength λ, and preferably lower than λ/4. The active resonant element 13 is near the proximal lateral surface LS.

The active resonant element 13 is preferably at the periphery. The device has a small size.

The active resonant element 13 has a second structure comprising a second shape and second physical parameters.

In case of the first embodiment of the invention:

the second structure is an electrical conductive wire;

the second shape is a straight line having a direction D; and the second physical parameters comprise a diameter, a length $L_{w2}$, and a chosen material for said electrical wire.

In the particular first embodiment, the second shape of the active resonant element is identical to the first shape of the passive resonant element. The active resonant element 13 differs from the passive resonant element 12 only by the length $L_{w2}$ that is shorter than the length $L_{w1}$. The passive and active resonant elements 12, 13 only differ by their physical parameters. The second structure of the active resonant element is therefore different to the first structure of the passive resonant element.

The active resonant element 13 has a resonance frequency, named a second resonance frequency $f_2$. The second resonance frequency $f_2$ is comprised between $f_{\Delta 1}$ and $f_{\Delta 2}$, i.e. inside the band-gap Δf of the plurality of passive resonant elements 12.

The electrical length of the wire of the active resonant element 13 is for example reduced compared to the electrical length of the wire of the passive resonant element 12: The second resonance frequency $f_2$ of the active resonant element 13 is higher than the first frequency f1 of the passive resonant elements 12, and said second resonance frequency $f_2$ can fall inside the band-gap Δf.

However, the plurality of passive resonant elements 12 does not propagate waves belonging to said band-gap Δf.

Figure 2:
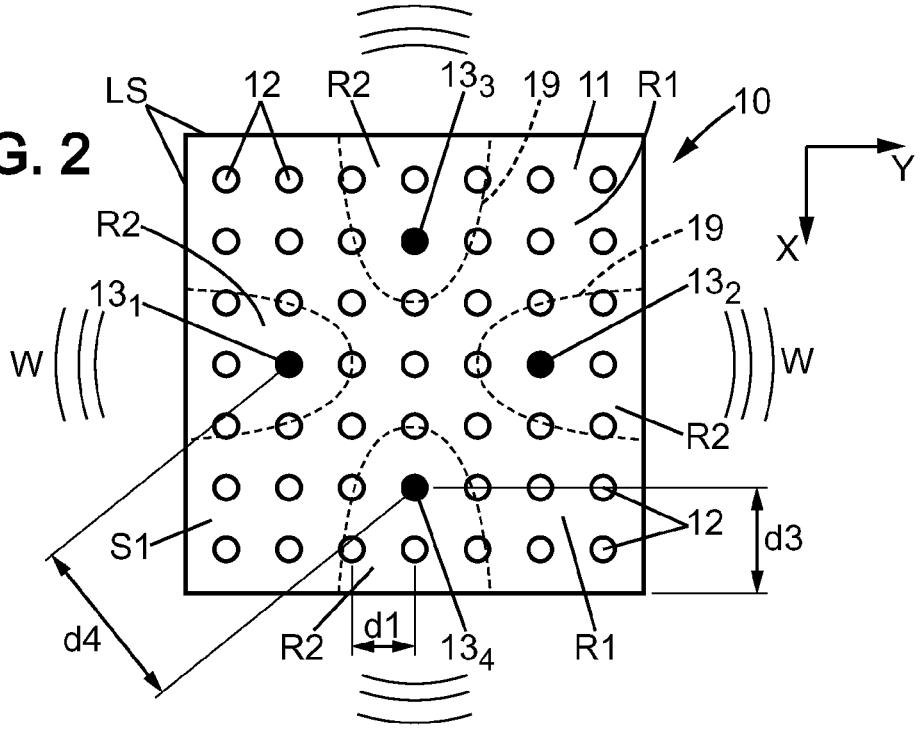
FIG. 2 is an upper view of a variant of the first embodiment of FIG. 1.

An emitted wave W emitted form the active resonant element 13 is attenuated in the direction of the plurality of passive resonant elements 12. The device behaves such as having a first region R1 comprising most of the passive resonant elements 12, and a second region R2 comprising the active resonant elements 13, the first and second region R1, R2 excluding each other and being separated by a boundary 19 (FIG. 2). The second region R2 around the active resonant elements 13 concentrates the electromagnetic energy coming from the active resonant element 13 and the first region R1 prevents the propagation of said energy through it.

Figure 3:
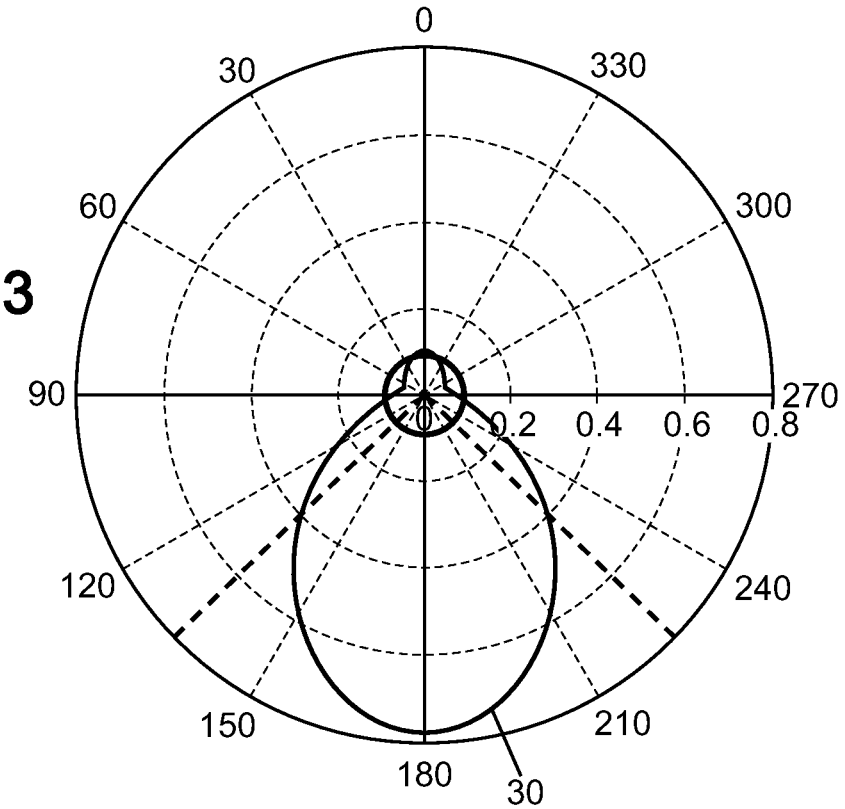
FIG. 3 is a directivity diagram concerning an active element belonging to the device of FIG. 2.

The device is therefore able to emit or to receive an electromagnetic wave W according to a predetermined direction or several predetermined directions, said predetermined directions being defined by the shapes of the first and second regions R1, R2. FIG. 3 is an example of directivity diagram corresponding to one active resonant element 13 of the device shown on FIG. 2. Such device has a clear directivity curve 30 oriented to the direction of 180°.

Thanks to these predetermined directivity diagram of each active resonant element 13, the device can emit a different signal from each active resonant element 13 for a multi-input multi-output (MIMO) application.

Additionally, a signal having a frequency component substantially equal to the second frequency $f_2$ can be efficiently emitted or received.

The device can emit or receive an electromagnetic wave in the far field, with an improved sensitivity compared with a device wherein the second frequency $f_2$ of the active resonant element 13 is not inside the band-gap Δf of the plurality of passive resonant elements 12.

The shapes of the active resonant elements 13 are preferably identical to the shape of the passive resonant element 12. At least one of the physical parameters of the active resonant elements 13 is different than physical parameters of the passive resonant elements 12. The active resonant element 13 can have a second resonance frequency $f_2$ inside the band-gap Δf of the plurality of passive resonant elements 12.

The device of FIG. 2 comprises four active resonant elements $\mathbf{13}_1$, $\mathbf{13}_2$, $\mathbf{13}_3$, $\mathbf{13}_4$, each of them emitting or receiving an electromagnetic wave W according to a different direction, for example according to a direction of each quadrant in the plane XY.

In case of emission, the electric signals of the plurality of active resonant elements 13 can be different from each other. In case of reception, the electric signals of the plurality of active resonant elements 13 can be different and uncorrelated to each other.

These active resonant elements 13 may be used independently from each other and may be used in a MIMO configuration of the device.

This device comprising a plurality of active resonant elements 13 is an extremely compact array of antenna.

Moreover, two active resonant elements ($\mathbf{13}_1$, $\mathbf{13}_2$) are separated from each other of a forth distance d4.

The forth distance d4 between two active resonant elements 13 is preferably higher than the second distance d2 between an active resonant element 13 and a neighbour passive resonant element 12. At least one passive resonant element 12 is for example between two active resonant elements 13. The active resonant elements 13 belonging to the plurality are not coupled to each other.

The forth distance d4 is for example lower than the wavelength in the medium 11, and preferably lower than λ/4. The device comprising a plurality of active resonant elements 13 is small.

The electric signals of the plurality of active resonant elements 13 are therefore more uncorrelated to each other, so that they can be used independently.

The two active resonant elements ($\mathbf{13}_1$, $\mathbf{13}_2$) may also have different second physical parameters, so that the first active resonant element $\mathbf{13}_1$ has a second resonant frequency $f_{21}$ that is different than the second resonant frequency $f_{22}$ of the second active resonant element $\mathbf{13}_2$.

The two active resonant elements ($\mathbf{13}_1$, $\mathbf{13}_2$) are then not coupled to each other, and the signals of the active resonant elements 13 are again more uncorrelated.

FIG. 6 represents a variant of the first embodiment of the invention, wherein the shapes of passive and active resonant elements 12, 13 are folded wires.

The passive resonant elements 12 are conductive wires of approximately 30 mm length, with first half portion in direction Z and second half portion in direction Y. The first resonance frequency $f_1$ corresponds to the above lengths of the passive resonant elements 12 conductive wires. In that case, the first resonance frequency f1 is approximately of 2.2 GHz.

The active resonant element 13 is a conductive wire of approximately 25 mm length, with first portion in direction Z and second portion in direction Y above the second half portions of the passive resonant elements 12. The second resonance frequency $f_2$ corresponds to the above length of the active resonant element 13 conductive wire. In that case, the second resonance frequency $f_2$ is approximately of 2.45 GHz.

The different portions of wires that are parallel to each other are distant of 2 mm.

The device can then emit and receive wave at a central frequency of approximately 2.45 GHz corresponding to the second resonance frequency $f_2$, and with a frequency bandwidth of approximately 100 MHz, said frequency bandwidth being comprised inside the frequency band-gap (Δf) of the passive resonant elements. The central frequency corresponds to a free space wavelength $\lambda_0$ between 20 cm and 12 cm. In this example, the first and second distances (d1, d3) are lower than λ/10.

The size of the device in the Y and Z directions of this variant is therefore smaller than in the device of FIG. 1.

Figure 7:
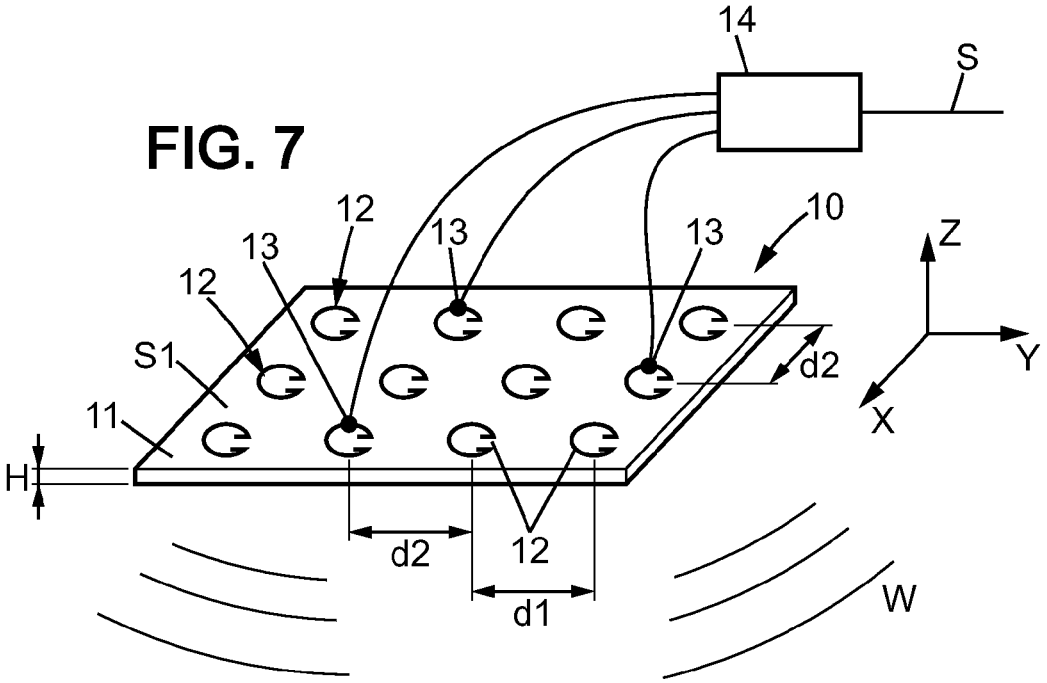
FIG. 7 is a perspective view of a second embodiment of a device for receiving or emitting an electromagnetic wave according to the invention.
Figure 8A:
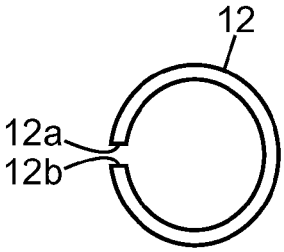
FIGS. 8*a* to 8*d* are four variants of a passive or active resonant element belonging to the device of FIG. 6.
Figure 8B:
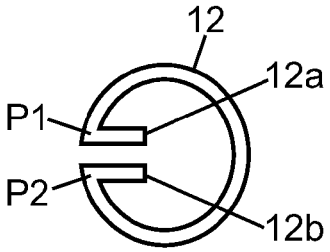
Figure 8C:
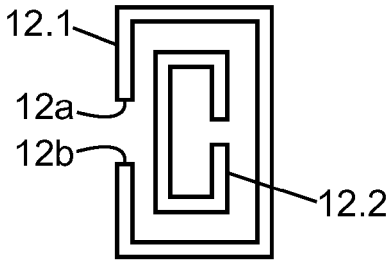
Figure 8D:
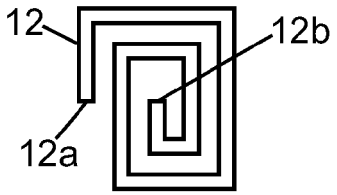

FIG. 7 shows a second embodiment of a device 10 for receiving or emitting an electromagnetic wave W comprising a plurality of passive resonant elements 12 and at least one active resonant element 13. These passive and active resonant elements have a different shape compared with those of the first embodiment.

These passive and active resonant elements 12, 13 are in the form of a split ring element extending in a plane XY above the first surface S1. Their structure also uses electrical conductive elements.

Such second embodiment of the invention is smaller in the direction Z compared to the first embodiment of the invention.

The first shape and the second shape are small loops having at least one opening, like a C letter. The loop behaves like an electric inductance L. The opening behaves like an electric capacitor C. The passive or active resonant element 12, 13 behaves like a small electric circuit having a resonance frequency $f_c$ that is substantially equal to $$\frac{1}{2\pi}\sqrt{LC}.$$

The passive resonant element 12 has a first resonance frequency $f_1$ depending on an electric capacitor $C_1$ and an electric inductance $L_1$. The active resonant element 13 has a second resonance frequency $f_2$ depending on an electric capacitor $C_2$ and an electric inductance $L_2$.

The plurality of passive resonant elements 12 has a band-gap Δf. The active resonant element 13 is designed to have a second resonance frequency inside the band-gap.

The other features for this embodiment of the invention are similar. And, it provides the same advantages.

All the optional variants are also possible.

Such device is small and efficient to emit or receive an electromagnetic wave W from or to far field.

FIGS. 8*a* to 8*d* shows four variants of shapes for the passive or active elements 12, 13. The variants of FIG. 7*c* provide two different second resonance frequencies ($f_{21}$, $f_{22}$).

The two second resonance frequencies can be positioned inside the frequencies band-gap Δf of the passive resonant elements 12.

Thanks to such a device having two active resonant elements 13, two waves can be emitted or received simultaneously, without interference, since the signal from them are uncorrelated because of the plurality of passive resonant elements 12 creating a band-gap.

Figure 9:
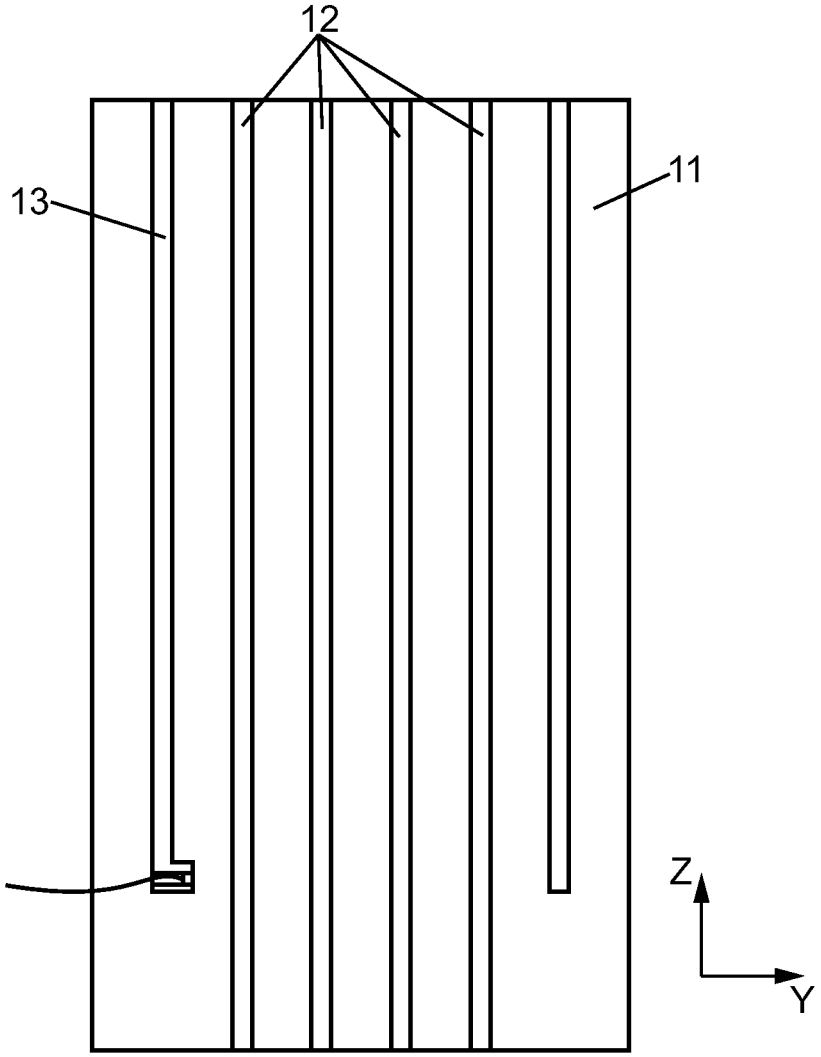
FIG. 9 is a view of a third embodiment of a device for receiving or emitting an electromagnetic wave according to the invention.

FIG. 9 shows a third embodiment of a device 10 for receiving or emitting an electromagnetic wave W comprising a plurality of passive resonant elements 12 and at least one active resonant element 13. These passive and active resonant elements have a different shape compared with those of the first embodiment: they are slots on an electrical conductor plate extending along a plane XY. The device of this third embodiment is smaller than the first and second ones. A first resonance frequency ($f_1$) depends on a perimeter length of the slot, and not a length of it. The perimeter is approximately twice longer than the length.

The passive resonant elements 12 are slots in an electric conductive plate of 24 mm length and 0.5 mm width. The first resonance frequency $f_1$ corresponds to the above length and width (perimeter) of the passive resonant elements 12 slots. In that case, the first resonance frequency fl is approximately of 2.2 GHz.

The active resonant element 13 is a slot of 19 mm length and 0.5 mm width. The second resonance frequency $f_2$ corresponds to the above length and width of the active resonant element 13 slot. In that case, the second resonance frequency $f_2$ is approximately of 2.45 GHz.

The slots are distant from each other of 2 mm.

The device can then emit and receive wave at a central frequency of approximately 2.45 GHz corresponding to the second resonance frequency $f_2$, and with a frequency bandwidth of approximately 100 MHz, said frequency bandwidth being comprised inside the frequency band-gap (Δf) of the passive resonant elements.

In this example, the first and second distances (d1, d3) are also lower than λ/10.

The size of this device in Y direction is twice lower than the size of FIG. 6. Such device is smaller.

According to all the embodiments of the invention, the device for receiving and/or emitting an electromagnetic wave is small compared to the equivalent known devices of the prior art.

Such device has a high efficiency to emit or receive an electromagnetic wave, so that data can be transmitted to a great distance from the device.

Moreover, the device can be designed to provide a predetermined directivity diagram that is determined by the first and second region shapes (region with passive resonant elements and region with active resonant element).

Additionally, the device can comprise a plurality of active resonant elements that are isolated from each other by the passive resonant elements 12 band-gap. The device can be used for MIMO application with very low correlation between the channels.

The invention claimed is:

1. A device for receiving and/or emitting an electromagnetic wave having a free space wavelength $\lambda_0$ between 1 mm and 10 m, the device comprising:

a medium of dielectric material, in which the free space wavelength $\lambda_0$ corresponds to a wavelength λ inside the dielectric medium;

a plurality of passive resonant elements incorporated inside the dielectric medium, each of the plurality of passive resonant elements having a first structure defined by at least a first shape and first physical parameters, and each of the plurality of passive resonant elements having at least a first resonance frequency ($f_1$) and comprising a frequency band-gap (Δf), in which two neighbour passive resonant elements are spaced apart from each other by a first distance (d1) lower than λ/4; and at least one active resonant element incorporated inside the plurality of passive resonant elements, the active resonant element being spaced apart from a passive resonant element by a second distance (d2) lower than λ/4, the active resonant element having a second structure defined by at least a second shape and second physical parameters, the second structure being different from the first structure so that the active resonant element has at least a second resonance frequency ($f_2$) comprised inside the frequency band-gap ($\Delta f$) of the plurality of passive resonant elements, wherein, the active resonant element is connected to an electronic device for receiving or emitting a signal (S) having at least a frequency component substantially equal to the second frequency ($f_2$), wherein the active resonant element is in proximity of a lateral surface (LS) of the medium.

2. The device according to claim 1, wherein the second shape is identical to said first shape, and at least one of the second physical parameters of the second structure is different to a corresponding first physical parameter of the first structure.

3. The device according to claim 1, wherein the first and second physical parameters comprise sizes and materials of the first and second structure, respectively.

4. The device according to claim 1, wherein the first distance and the second distance are lower than $\lambda/10$.

5. The device according to claim 1, wherein the passive resonant elements are not periodically disposed inside the medium.

6. The device according to claim 1, wherein said active resonant element is at a third distance (d3) from the lateral surface (LS), said third distance (d3) being lower than the wavelength $\lambda$ .

7. The device according to claim 1, comprising at least two active resonant elements, said two active resonant elements being separated from each other of a forth distance (d4), and wherein said two active resonant elements have different second resonance frequencies ($f_{21}$, $f_{22}$), each of them being comprised inside said band-gap ($\Delta f$).

8. The device according to claim 7, wherein the forth distance (d4) is lower than the wavelength $\lambda$ , and preferably lower than $\lambda/4$.

9. The device according to claim 7, wherein the forth distance (d4) is adapted so that at least one passive resonant element (12) is substantially between said two active resonant elements.

10. The device according to claim 7, wherein the two active resonant elements are positioned symmetrically in comparison to a geometrical centre of said device.

11. The device according to claim 1, comprising:

the plurality of passive resonant elements having the same first shapes and same first physical parameters, each passive resonant elements having a plurality of first resonance frequencies ($f_i$), and the plurality of passive resonant elements comprising at least a first band-gaps ($\Delta f_1$) and a second band-gap ($\Delta_2$), and at least two active resonant elements, said to active resonant elements being separated from each other of a forth distance (d4), and wherein said two active resonant elements have different second resonance frequencies ($f_{21}$, $f_{22}$) respectively, the first second resonance ($f_{21}$) being comprised inside a first band-gap ($\Delta f_1$) of said plurality of passive resonant elements, and the second second resonance ($f_{22}$) being comprised inside a second band-gap ($\Delta f_2$) of said plurality of passive resonant elements.

12. The device according to claim 1, comprising:

at least two sets of passive resonant elements, said sets having the same first shapes and different first physical parameters, so that a first set comprises a first band-gap ($\Delta f_1$) and a second set comprises a second band-gap ($\Delta f_2$), and at least two active resonant elements, said to active resonant elements being separated from each other of a forth distance (d4), and wherein said two active resonant elements have different second resonance frequencies ($f_{21}$, $f_{22}$) respectively, the first second resonance ($f_2$) being comprised inside the first band-gap ($\Delta f_1$), and the second second resonance ($f_{22}$) being comprised inside the second band-gap ($\Delta f_2$).

13. The device according to claim 1, wherein the first and second shapes are wires of electrical conductors, the first resonance frequency ($f_1$) depending on a length of said first shape, and the second resonance frequency ($f_2$) depending on a length of said second shape.

14. A device for receiving and/or emitting an electromagnetic wave having a free space wavelength $\lambda_0$ between 1 mm and 10 m, the device comprising:

a medium of dielectric material, in which the free space wavelength $\lambda_0$ corresponds to a wavelength $\lambda$ inside the dielectric medium;

a plurality of passive resonant elements incorporated inside the dielectric medium, each of the plurality of passive resonant elements having a first structure defined by at least a first shape and first physical parameters, and each of the plurality of passive resonant elements having at least a first resonance frequency $f_1$ and comprising a frequency band-gap ($\Delta f$), in which two neighbour passive resonant elements are spaced apart from each other by a first distance (d1) lower than $\lambda/4$; and at least one active resonant element incorporated inside the plurality of passive resonant elements, the active resonant element being spaced apart from a passive resonant element by a second distance (d2) lower than $\lambda/4$, the active resonant element having a second structure defined by at least a second shape and second physical parameters, the second structure being different from the first structure so that the active resonant element has at least a second resonance frequency $f_2$ comprised inside the frequency band-gap ($\Delta f$) of the plurality of passive resonant elements, wherein, the active resonant element is connected to an electronic device for receiving or emitting a signal (S) having at least a frequency component substantially equal to the second frequency ($f_2$) and wherein the first and second shapes are split rings of electrical conductors, the first resonance frequency ($f_1$) depending on an electric capacitor and an electric inductance of said first shape, and the second resonance frequency ($f_2$) depending on an electric capacitor and an electric inductance of said second shape.

15. A device for receiving and/or emitting an electromagnetic wave having a free space wavelength $\lambda_0$ between 1 mm and 10 m, the device comprising:

a medium of dielectric material, in which the free space wavelength $\lambda_0$ corresponds to a wavelength $\lambda$ inside the dielectric medium;

a plurality of passive resonant elements incorporated inside the dielectric medium, each of the plurality of passive resonant elements having a first structure defined by at least a first shape and first physical parameters, and each of the plurality of passive resonant elements having at least a first resonance frequency ($f_1$) and comprising a frequency band-gap ($\Delta f$), in which two neighbour passive resonant elements are spaced apart from each other by a first distance (d1) lower than $\lambda/4$; and at least one active resonant element incorporated inside the plurality of passive resonant elements, the active resonant element being spaced apart from a passive resonant element by a second distance (d2) lower than $\lambda/4$, the active resonant element having a second structure defined by at least a second shape and second physical parameters, the second structure being different from the first structure so that the active resonant element has at least a second resonance frequency ($f_2$) comprised inside the frequency band-gap ($\Delta f$) of the plurality of passive resonant elements, wherein, the active resonant element is connected to an electronic device for receiving or emitting a signal (S) having at least a frequency component substantially equal to the second frequency ($f_2$), and wherein the first and second shapes are slots on an electrical conductor plate, the first resonance frequency ($f_1$) depending on a perimeter length of the slot of said first shape, and the second resonance frequency ($f_2$) depending on a length of the slot of said second shape.

16. A system comprising a device for receiving and/or emitting an electromagnetic wave according to claim 1, wherein the active resonant element is connected to an electronic device for receiving and/or emitting a signal representative to said electromagnetic wave, said electric signal having at least a frequency component substantially equal to the second frequency ($f_2$).

* * * * *